US009355524B2

(12) United States Patent
Suda et al.

(10) Patent No.: US 9,355,524 B2
(45) Date of Patent: May 31, 2016

(54) GAMING MACHINE DISPLAYING SELECTED SYMBOLS IN CELLS

(75) Inventors: Satoshi Suda, Las Vegas, NV (US); Deven Hubbard, Las Vegas, NV (US)

(73) Assignee: KONAMI GAMING, INC., Las Vegas, NV (US)

( * ) Notice: Subject to any disclaimer, the term of this patent is extended or adjusted under 35 U.S.C. 154(b) by 208 days.

(21) Appl. No.: 12/284,294

(22) Filed: Sep. 19, 2008

(65) Prior Publication Data

US 2010/0075740 A1 Mar. 25, 2010

(51) Int. Cl.
*G07F 17/32* (2006.01)

(52) U.S. Cl.
CPC ..... *G07F 17/3267* (2013.01); *G07F 17/3244* (2013.01)

(58) Field of Classification Search
CPC ..... G07F 17/3267
USPC ..... 463/20
See application file for complete search history.

(56) References Cited

U.S. PATENT DOCUMENTS 6,413,162 B1 * 7/2002 Baerlocher et al. ..... 463/20
7,252,589 B1 * 8/2007 Marks ..... G07F 17/3265 463/16
7,740,536 B2 * 6/2010 Pederson et al. ..... 463/20
2002/0039918 A1 * 4/2002 Anderson ..... A61F 9/183 463/16
2003/0083120 A1 * 5/2003 DeWall et al. ..... 463/16
2004/0033827 A1 * 2/2004 Gilmore et al. ..... 463/20
2004/0048646 A1 * 3/2004 Visocnik ..... G07F 17/32 46/16
2004/0242315 A1 * 12/2004 Paulsen et al. ..... 463/20
2005/0070354 A1 * 3/2005 Baerlocher ..... G07F 17/3244 463/20
2006/0089191 A1 * 4/2006 Singer et al. ..... 463/20
2006/0111173 A1 * 5/2006 Yang ..... 463/20
2006/0264254 A1 * 11/2006 Aoki ..... G07F 17/3267 463/20
2007/0060248 A1 * 3/2007 Rodgers ..... G07F 17/32 463/16
2007/0232383 A1 10/2007 Berman
2007/0254735 A1 * 11/2007 Marks ..... G07F 17/34 463/20
2007/0275778 A1 11/2007 Fong et al.
2008/0132309 A1 * 6/2008 Baumgartner et al. ..... 463/16
2008/0167113 A1 7/2008 Plowman
2008/0194313 A1 8/2008 Walker
2008/0287179 A1 * 11/2008 Berman et al. ..... 463/20
2009/0124338 A1 * 5/2009 Watkins et al. ..... 463/20

(Continued)

FOREIGN PATENT DOCUMENTS

GB 2415279 A 12/2005

OTHER PUBLICATIONS

Examiner's first report on AU patent application No. 2009212873, Issued on Sep. 30, 2010, Patent Examiner Chirag Mehta, IP Australia.

(Continued)

*Primary Examiner* — Damon Pierce
*Assistant Examiner* — Anh Vo V Nguyen
(74) *Attorney, Agent, or Firm* — Masuvalley & Partners

(57) ABSTRACT

The present invention is a gaming machine, including a display which displays a plurality of cells for presenting a plurality of symbols in a game, a processor which executes the game, chooses at least two cells from the plurality of cells and a symbol from the plurality of symbols and presents the chosen symbol in the chosen cells, and a payout device which awards a reward according to an symbol arrangement on the cells, wherein each of the plurality of cells displays a symbol independently from each other.

10 Claims, 14 Drawing Sheets

(56) References Cited

U.S. PATENT DOCUMENTS

| | | | | |
|---|---|---|---|---|
| 2010/0004048 | A1* | 1/2010 | Brito | G07F 17/3265 463/20 |
| 2010/0075741 | A1* | 3/2010 | Aoki et al. | 463/20 |

OTHER PUBLICATIONS

Examiner's second report on AU patent application No. 2009212873, Issued on May 9, 2011, Patent Examiner Chirag Mehta, IP Australia.

* cited by examiner

SYMBOL SELECTION

Before line selection

After line selection

GAMING MACHINE DISPLAYING SELECTED SYMBOLS IN CELLS

TECHNICAL FIELD

The present invention relates to a gaming machine provided with a reel display, which is used in casinos.

BACKGROUND OF THE INVENTION

Now, generally many slot machines, which execute a reel game, are installed in casinos. In these slot machines, there exist many machines, which execute a game including a primary game and a free spin game. Since the free spin game is usually carried out as a bonus game of the primary game, the free spin game is set up so that higher prizes may be paid to a player, and is positioned as a game, which further excites a player. However, the conventional free spin game was performed in a form just like a primary game, and it had the feature that winning combination appears with high probability. However the free spin game is insufficient as a position of a bonus game, and it has not excited players enough. An appearance of a secondary game, such as a free spin game, which can excite players more under such a status, has been desired.

SUMMARY OF THE INVENTION

One aspect of the present invention may be a gaming machine, including a display which displays a plurality of cells for presenting a plurality of symbols in a game, a processor, which executes the game, selects at least two cells from the plurality of cells and a symbol from the plurality of symbols and presents the selected symbol in the selected cells and a payout device which awards a reward according to an symbol arrangement on the selected cells, wherein each of the plurality of cells displays a symbol independently from each other.

Since, by having the above-mentioned structure, a reel game generally and formerly performed can be provided with new thought and a sense of value, the conventional reel game can be made born again in a completely new game. Since a free spin game (only henceforth a free game) is a bonus game, a player imagines that a set of symbol can be obtained with a high probability and more prizes can be received. However, in the conventional free game, a player does not know what kind of symbol is displayed on all cells on a reel, and it is anticipated that a variety of symbols having completely different patterns are displayed on these cells. This disagrees with an idea of a player currently expecting that more sets of symbol should be arranged on a pay line. Since a fixed symbol is displayed on a selected cell according to the above-mentioned structure, a player easily imagines that a set of symbols can easily be arranged on a pay line. Thus it is possible for the player to swell more expectation for bigger prize acquisition.

The game may include a first game and a second game. The processor may select at least two cells in the first game and a symbol in the second game, and may present the selected symbol in the selected cells in the second game. The processor may execute a free spin game in the second game. The game may include a bonus game and the processor may initiate the bonus game after indicating trigger information in the game.

The processor may randomly select at least the two cells. The processor may regularly select at least the two cells.

The processor may select at least the two cells according to an instruction out of the gaming machine. By having this structure, it is possible to allow a player to select a cell on a reel. Therefore, an intention of the player can be taken into a game. Therefore, it becomes possible to allow the player to feel that the player himself or herself operates the game.

The processor may select a number of cells different from a number, which the processor has previously selected. The processor may select a number of cells larger than a number, which the processor has previously selected.

By having the above-mentioned structure, the number of cells, which display a fixed symbol, changes during free game progress. Therefore, it becomes possible to realize a situation where there are a small number of cells, which display a fixed symbol in a certain reel spin, and there are a large number of cells, which display a fixed symbol in a certain reel spin. Therefore, variety can be given to game nature more and it becomes possible to develop the game which is rich in variety.

Another aspect of the present invention may be a gaming machine for executing a primary game and a secondary game and paying out credit, including a display, which displays a plurality of cells with symbols and a plurality of lines on the cells, and a processor, which selects a line from the plurality of lines and a symbol from the plurality of symbols and presents the selected symbol in cells related to the selected line.

Since, by having the above-mentioned structure, a reel game generally and formerly performed can be provided with new thought and a sense of value, the conventional reel game can be made born again in a completely new game. Since a free spin game (only henceforth a free game) is a bonus game, a player imagines that a set of symbols can be obtained with a high probability and more prizes can be received. However, in the conventional free game, a player does not know what kind of symbol is displayed on all cells on a reel, it is anticipated that a variety of symbols having completely different patterns are displayed on these cells. This disagrees with an idea of a player currently expecting that more sets of symbol should be arranged on a pay line. Since a fixed symbol is displayed on a selected cell according to the above-mentioned structure, a player easily imagines that many sets of symbol can easily be arranged on an entire reel. Thus it is possible for the player to swell more expectation for bigger prize acquisition.

The line may include a straight line or a zigzag line. The secondary game may include a first secondary game and a second secondary game. The processor may select the line in the first secondary game and present the symbols in cells related to a selected line in the second secondary game. The processor may operate a free spin game in the second secondary game.

The processor may randomly select the line from the plurality of lines. The processor may regularly select the line from the plurality of lines.

The processor may select the line from the plurality of lines according to an instruction out of the gaming machine. By having this structure, it is possible to allow the player to select a cell on a reel. Therefore, an intention of the player can be taken into a game. Therefore, it becomes possible to allow the player to feel that the player himself of herself operates the game.

Another aspect of the present invention may be a method for playing a game, including the steps of presenting a plurality of symbols in cells in a primary game, indicating trigger information in the primary game, initiating a secondary game with cells presenting a plurality of symbols, selecting at least two cells in the cells and a symbol from the plurality of symbols in the secondary game, displaying the selected symbol in the selected cells, and awarding credit when symbols displayed in the cells form a winning combination.

Since, by having the above-mentioned structure, a reel game generally and formerly performed can be provided with new thought and a sense of value, the conventional reel game can be made born again in a completely new game. Since a free spin game (only henceforth a free game) is a bonus game, a player imagines that a set of symbols can be obtained with a high probability and more prizes can be received. However, in the conventional free game, a player does not know what kind of symbol is displayed on all cells on a reel, it is anticipated that a variety of symbols having completely different patterns are displayed on these cells. This disagrees with an idea of a player currently expecting that more sets of symbol should be arranged on a pay line. Since a fixed symbol is displayed on a selected cell according to the above-mentioned structure, a player easily imagines that a many symbols can easily be arranged on a pay line. Thus it is possible for the player to swell more expectation for bigger prize acquisition.

The displaying step may include the step of displaying the selected symbol in the selected cells so that the winning combination is formed. The presenting step may include the step of presenting the plurality of symbols in the cells, each cell independently displaying a symbol from each other.

Another aspect of the present invention may be a gaming machine for paying out award according to a bet, including a display, which displays a plurality of cells with symbols and a plurality of lines on the cells, a processor, which assigns a plurality of cells or a line as a pay line and presents symbols on the cells along the assigned pay line, and a payout device which pays out award when the symbols arranged along the assigned pay line form a winning combination.

By having the above-mentioned structure, it is possible for a player to select a pay line on a reel and to enjoy a reel game using the pay line. Therefore, an intention of the player can be taken into a game. Therefore, it becomes possible to allow the player to feel that the player himself or herself operates the game. For example, when a player is allowed to execute the selection of a pay line in a bonus game, the player will expect that the player can obtain a big prize as a matter of course when one of pay lines is selected. On the other hand, the player also expects that there is a pay line, which can obtain only small prizes. When such a mental state is given to the player, the player can have excited feeling, which results in connection with earning growth of a casino.

The processor may assign the pay line according to an instruction out of the gaming machine. By having this structure, it is possible to allow a player to select a cell on a reel. Therefore, an intention of the player can be taken into a game. Therefore, it becomes possible to allow the player to feel that the player himself or herself operates the game.

DETAILED DESCRIPTION OF INVENTION

Figure 1:
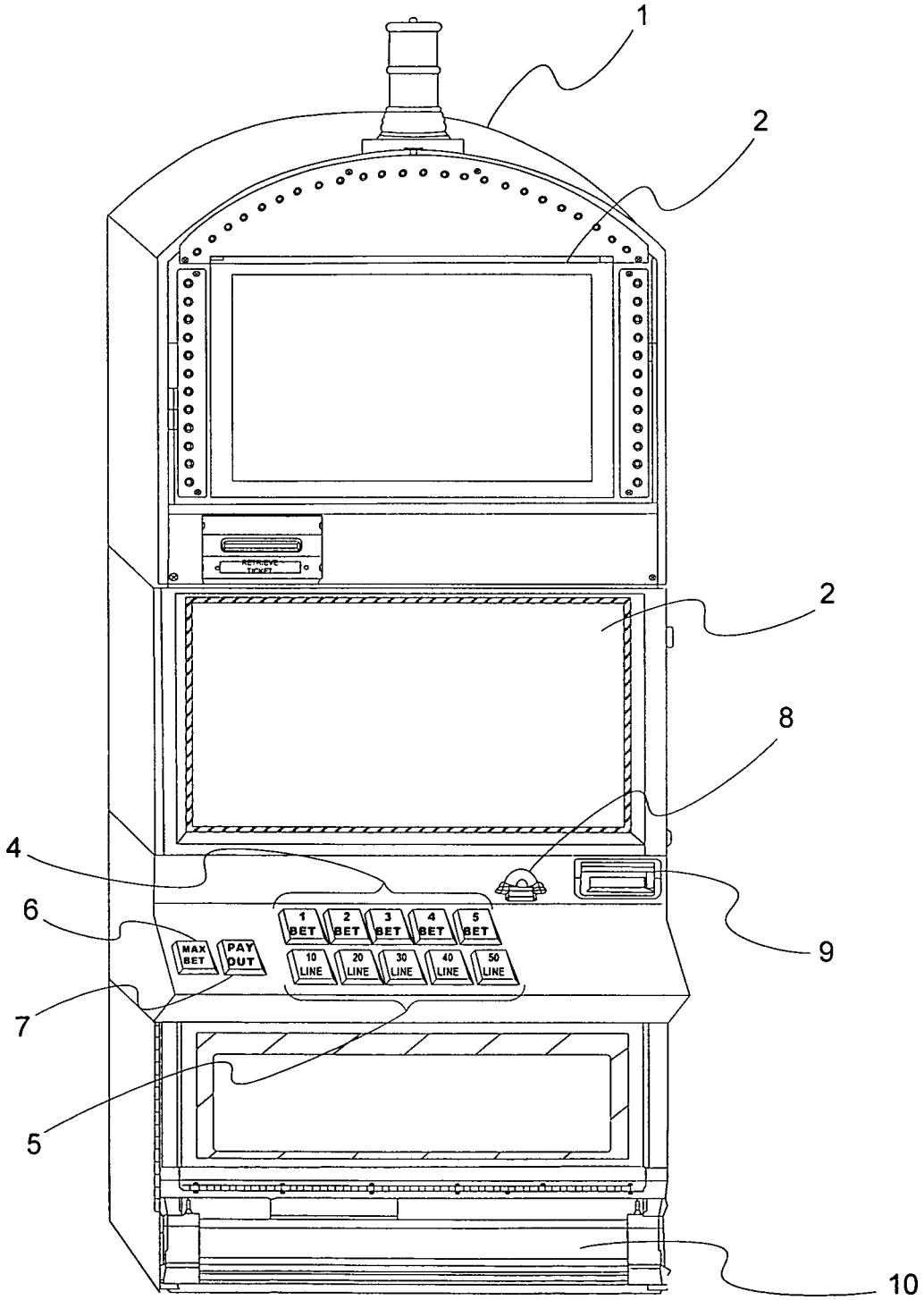
FIG. 1 is a perspective view showing an example of a gaming machine of the present invention.

FIG. 1 is a perspective view showing an example of a gaming machine of the present invention. As shown in FIG. 1, a gaming machine 1 is provided with two displays 2. Immediately under the displays 2, there are provided BET switches 4, selection switches 5, a MAXBET switch 6, a PAYOUT switch 7, and a coin slot 8 and a bill acceptor 9. The BET switches 4 include five switches from 1BET to 5BET. The selection switches 5 include five switches from 1 (one) select to 5 (five) selects. A coin payout mouth 10 is provided in the lower part of gaming machine 1.

An indication required by a player to play a game is displayed on the displays 2. For example, the indication for performing a primary game or a secondary game is displayed on the displays 2. Cards used by a card game, roulette used in a roulette game, coins and a reel used in a reel game, a feature, etc. are displayed on displays 2, for example. An indication for a player to select a kind of a progressive game or a bonus game and an indication for a player to select a feature are also displayed. A progressive screen etc., which displays the amount of money, which a player can obtain, may be displayed on the displays 2. The direction according to a progress status of a game, a credit, which a player feeds into a gaming machine, and play history of the player may be displayed on display 2.

The BET switches 4 are switches for inputting a bet on the game. The player can input a bet from 1BET to 5BET using the BET switches one time for a game. A selection switch 5 is a switch for, for example, selecting a line on a reel and a card, which a player wants to throw away, etc. The numbers of BET switch 4 and selection switches 5 may not be limited to five, but may be any number. The gaming machine 1 may have a switch for casting 10BET, for example, and may have a switch of 10select.

A MAXBET switch 6 is a switch for inputting the maximum bet that a player can spend one time on a game. A PAYOUT switch 7 is a switch for rewarding the amount of money to a player, which has been credited onto the gaming machine. A coin slot 8 is a hole for a player to perform the credit of the coin to the gaming machine. A bill acceptor 9 is a hole used in order to feed a bill or a cash card into the gaming machine, or in order to repay the amount of money, which has been credited. The coin tray mouth 10 is a tray to reward the amount of money to a player, which has been credited in the gaming machine.

A gaming machine related to the present invention is not limited to the above, but it may have various functions otherwise, and the above-mentioned function may be omitted. For example, the gaming machine may have a lighting apparatus for making a gaming machine to turn on the lighting apparatus using a color or more colors when a player rushes into the secondary game. The gaming machine may have an apparatus for outputting music or an apparatus, which vibrates the whole gaming machine, when a player rushes into a secondary game. The gaming machine 1 may have three or more displays. The gaming machine 1 may have a switch for choosing the BET, which a player applied in the last game again.

A reel, roulette, etc. which are used in the game, do not need to be displayed on the display. A stepper (mechanical reel), mechanical roulette, etc. may be mounted in gaming machine 1. There may exist a display etc., which are used in a plurality of gaming machines in common.

Next, a game, which is executed by a gaming machine related to the present invention, will be described. A game related to the present invention will be executed in a reel game. Usually, this game has three stages. On the first stage, a usual reel game (a primary game) is executed and the trigger of the free game is performed at a predetermined timing. When the trigger of the game is performed, a free game will be started after that. In starting a free game, a predetermined cell on a reel is selected on the second stage. On the third stage, the free game is executed, the reel rotates predetermined number-of-times and a symbol is displayed on a reel after every rotation. In the free game, only a symbol selected in advance is displayed in the cells, which have been selected. The contents of the game related to the present invention are roughly mentioned as above. A game, which is executed by a gaming machine related to the present invention, will be hereafter concretely described.

Figure 2:
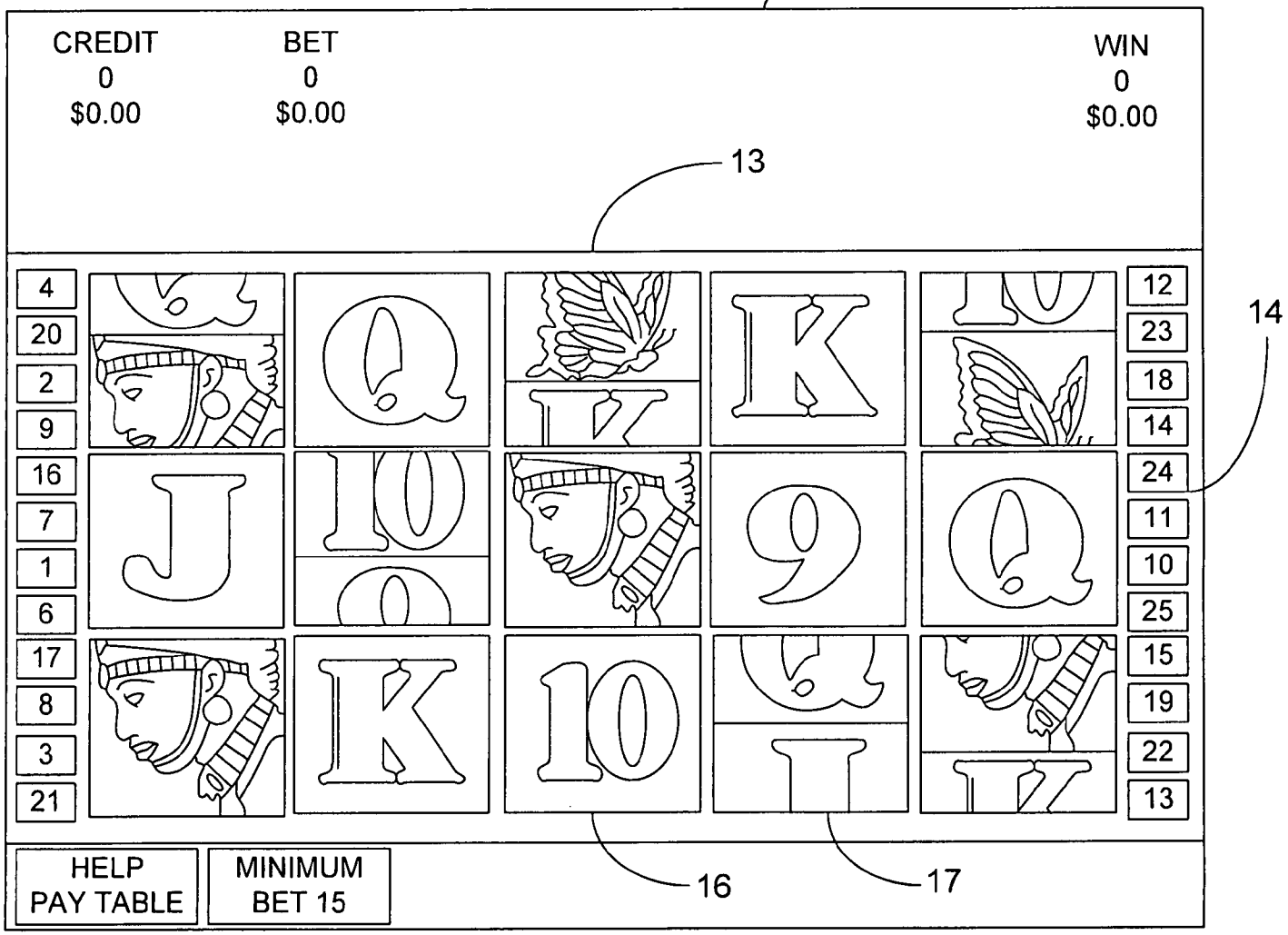
FIG. 2 is a drawing showing an example of a game executed by a gaming machine related to the present invention.

FIG. 2 is a drawing showing an example of the game, which is executed by a gaming machine related to the present invention. FIG. 2 illustrates a display 2. A reel 13 is displayed on the display 2. The reel 13 has a plurality of cells, and a plurality of symbols is shown in these cells. And the reel 13 has further a plurality of pay lines 14. Each cell may be arranged to independently display a symbol from others respectively. That is, as shown in FIG. 2, each cell is configured so that a symbol may be rotated separately. For example, in a certain cell 16 a symbol has already been displayed, and in a certain cell 17, it is in the state where a symbol is still rotating. And after all the cells have displayed one symbol on each cell, it is decided whether winning combination is established on a pay line. The above-mentioned operation is repeated on the first stage.

Figure 3:
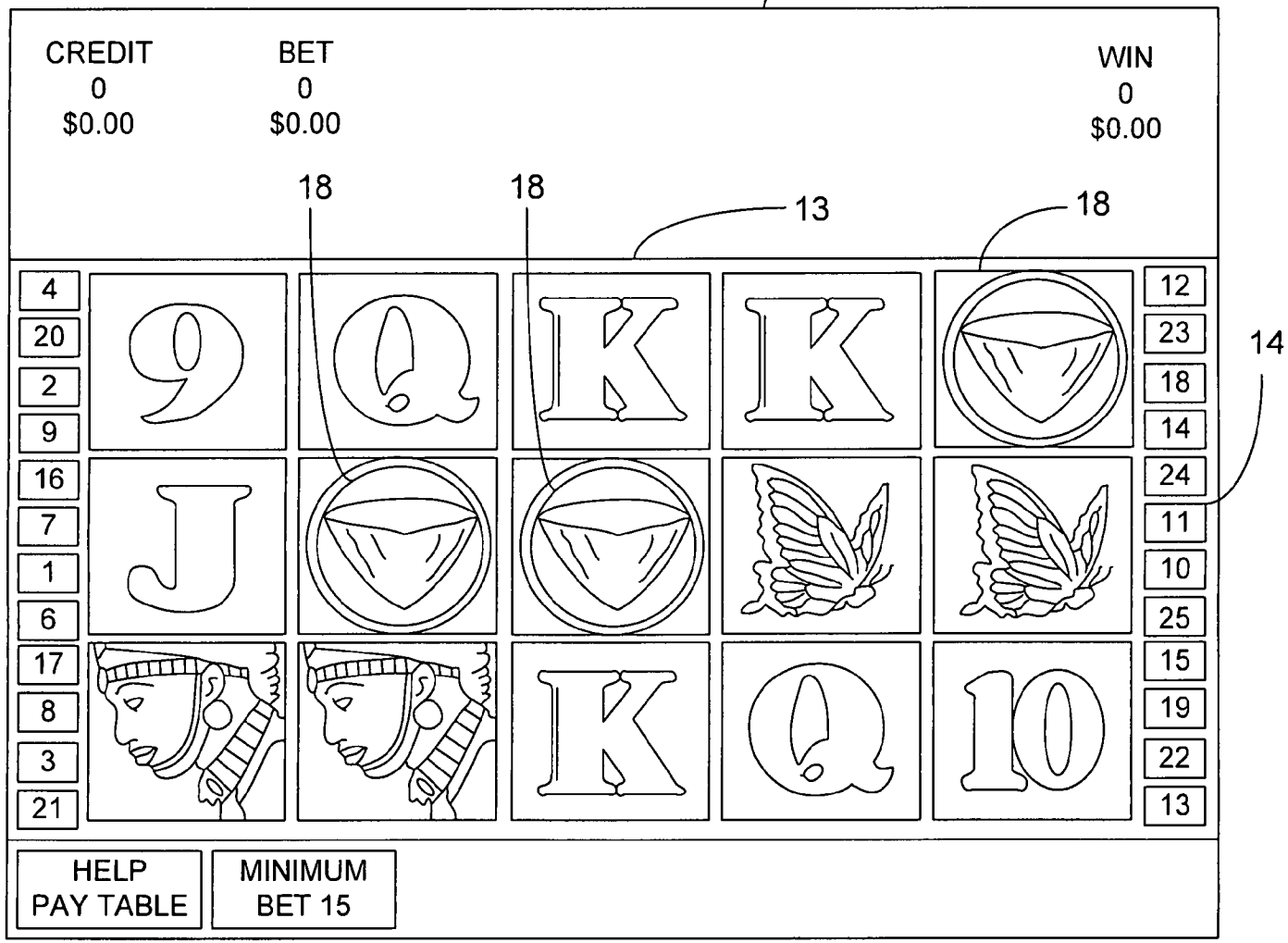
FIG. 3 is a drawing showing the state where the game shown in FIG. 2 has advanced further.

FIG. 3 is a drawing showing the state where the game shown in FIG. 2 has advanced further. The display 2 is shown in FIG. 3. The reel 13 having a plurality of cells and symbols and a plurality of pay lines is displayed on display 2. FIG. 3 illustrates a state where a plurality of symbols has been displayed on a reel after the reel has rotated. Three symbols 18 have been arranged on a certain pay line, and the trigger of the free game is performed based on this arrangement. There are many cases where the reel rotates again after reel rotation to continue a normal game because the free game has not been triggered.

Figure 4:
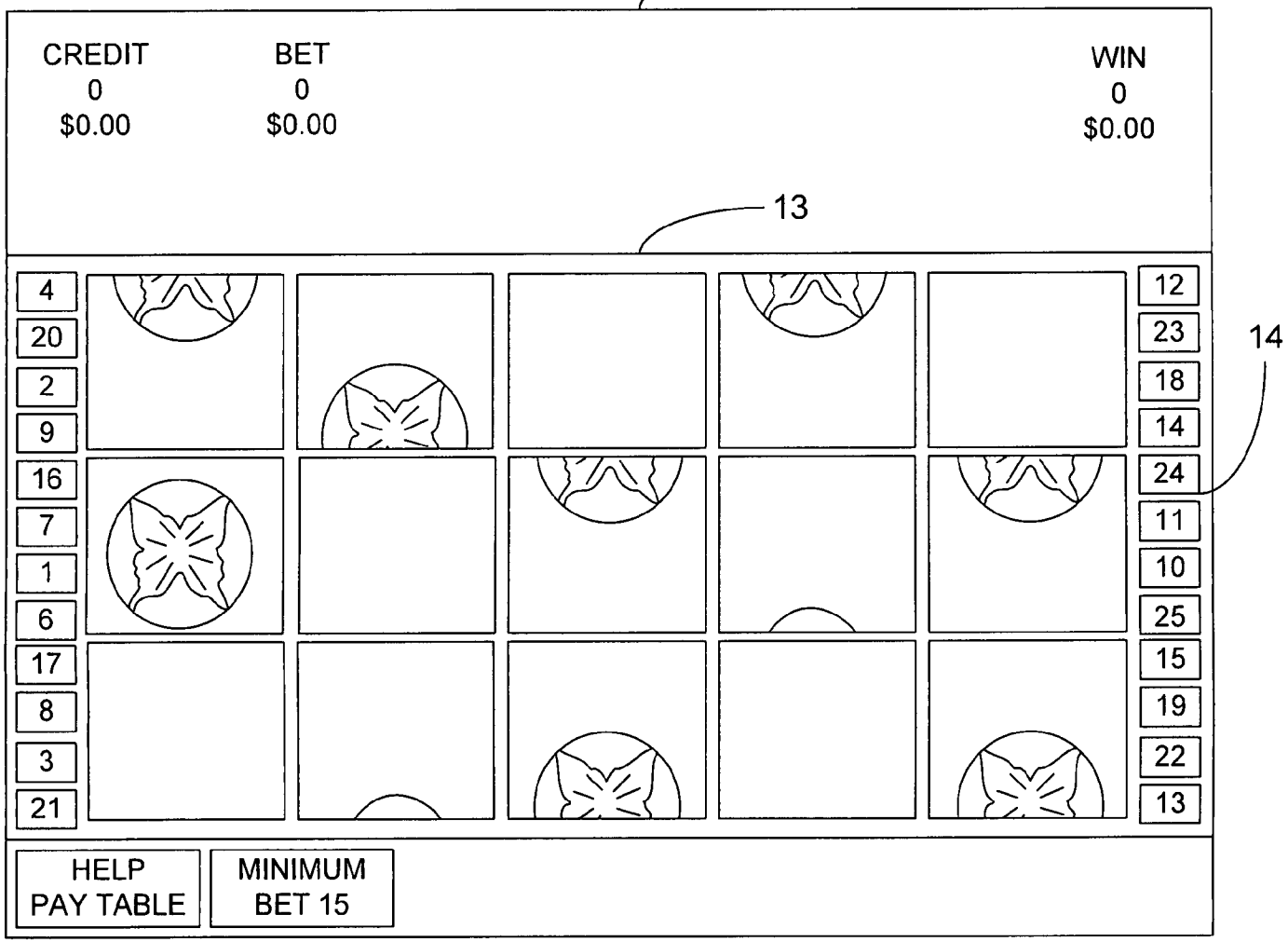
FIG. 4 is a drawing showing the state where the game shown in FIG. 3 has advanced further.

FIG. 4 is a drawing showing the state where the game shown in FIG. 3 has advanced further. The display 2 is shown in FIG. 4. The reel 13 having a plurality of cells and symbols and a plurality of pay lines is displayed on display 2. FIG. 4 shows the state where some cells are selected, after the primary game has been executed and the trigger of the free game has been performed. A pattern as shown in the drawing is displayed on a reel before the selection of a cell is performed.

Figure 5:
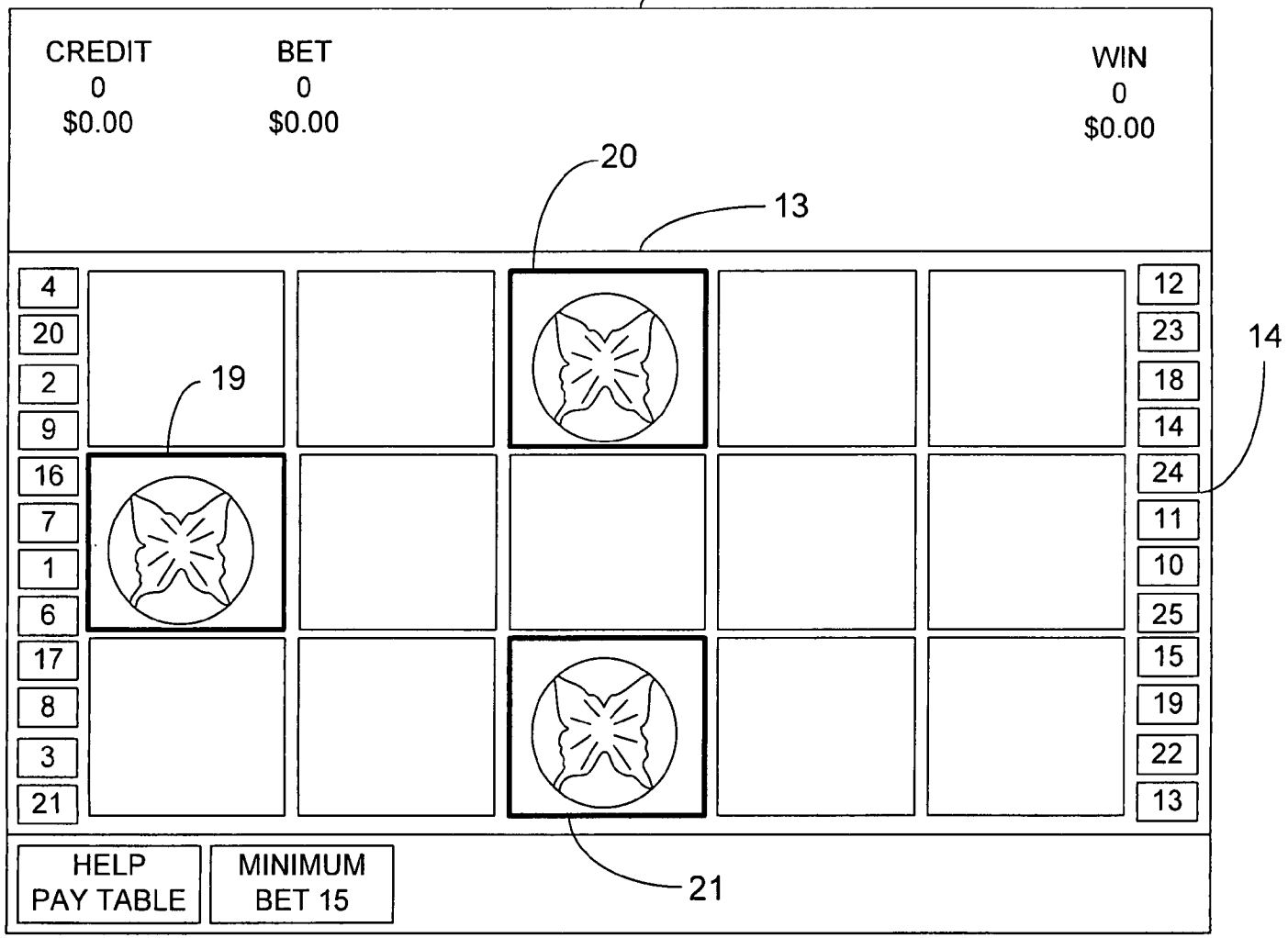
FIG. 5 is a drawing showing the state where the game shown in FIG. 4 has advanced further.

FIG. 5 is a drawing showing the state where the game shown in FIG. 4 has advanced further. The display 2 is shown in FIG. 5. The reel 13 having a plurality of cells and symbols, and a plurality of pay lines is displayed on display 2. FIG. 5 shows the state where selection of a predetermined cell used in a free game is performed. In FIG. 5, cells 19-21 are selected and only a predetermined and selected symbol is displayed on these three cells in a free game.

Figure 6:
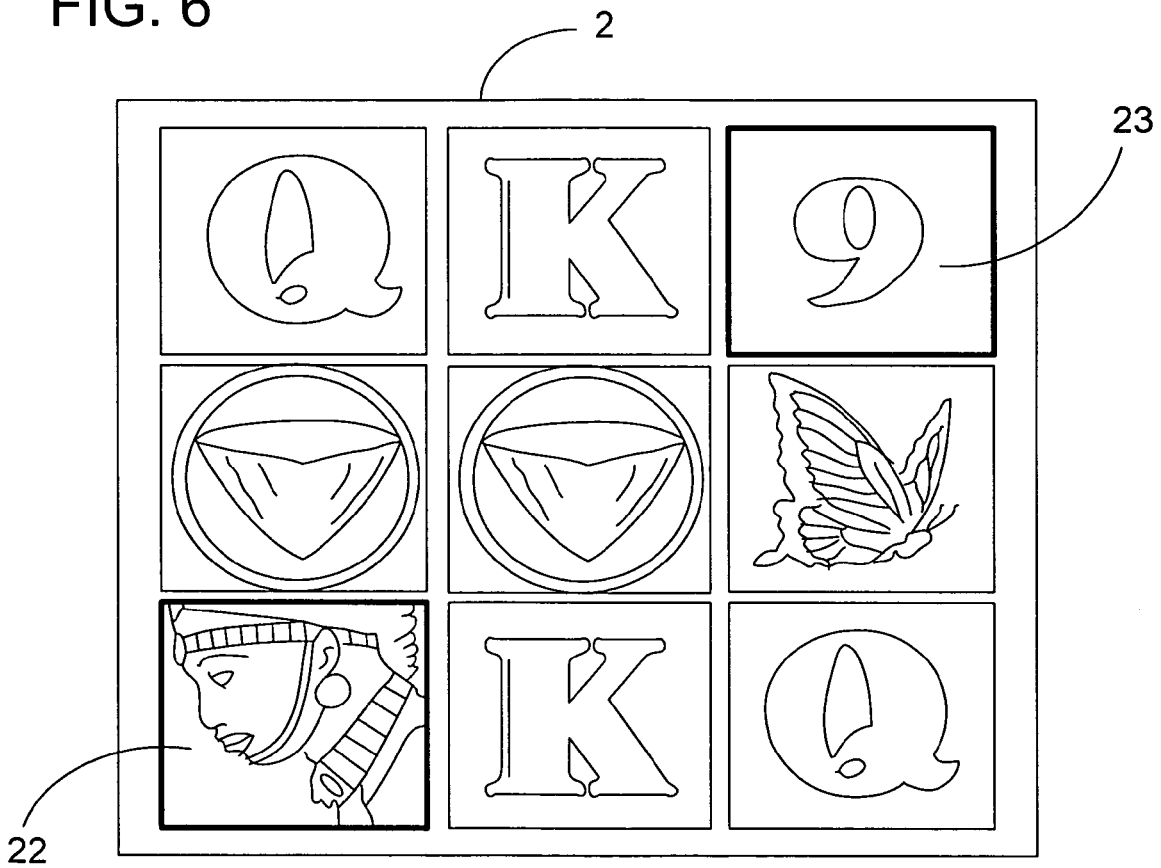
FIG. 6 is a drawing showing the state where the symbol displayed on a selected cell is determined.

FIG. 6 is a drawing showing the state where a symbol displayed on a selected cell is determined. The display 2 is shown in FIG. 6. A plurality of cells is displayed on the display 2, and symbols are displayed into these cells. As shown in the drawing, symbols 22 and 23 are selected and in a free game, the selected symbol is displayed in the cell, which has been selected in FIG. 5.

Figure 7:
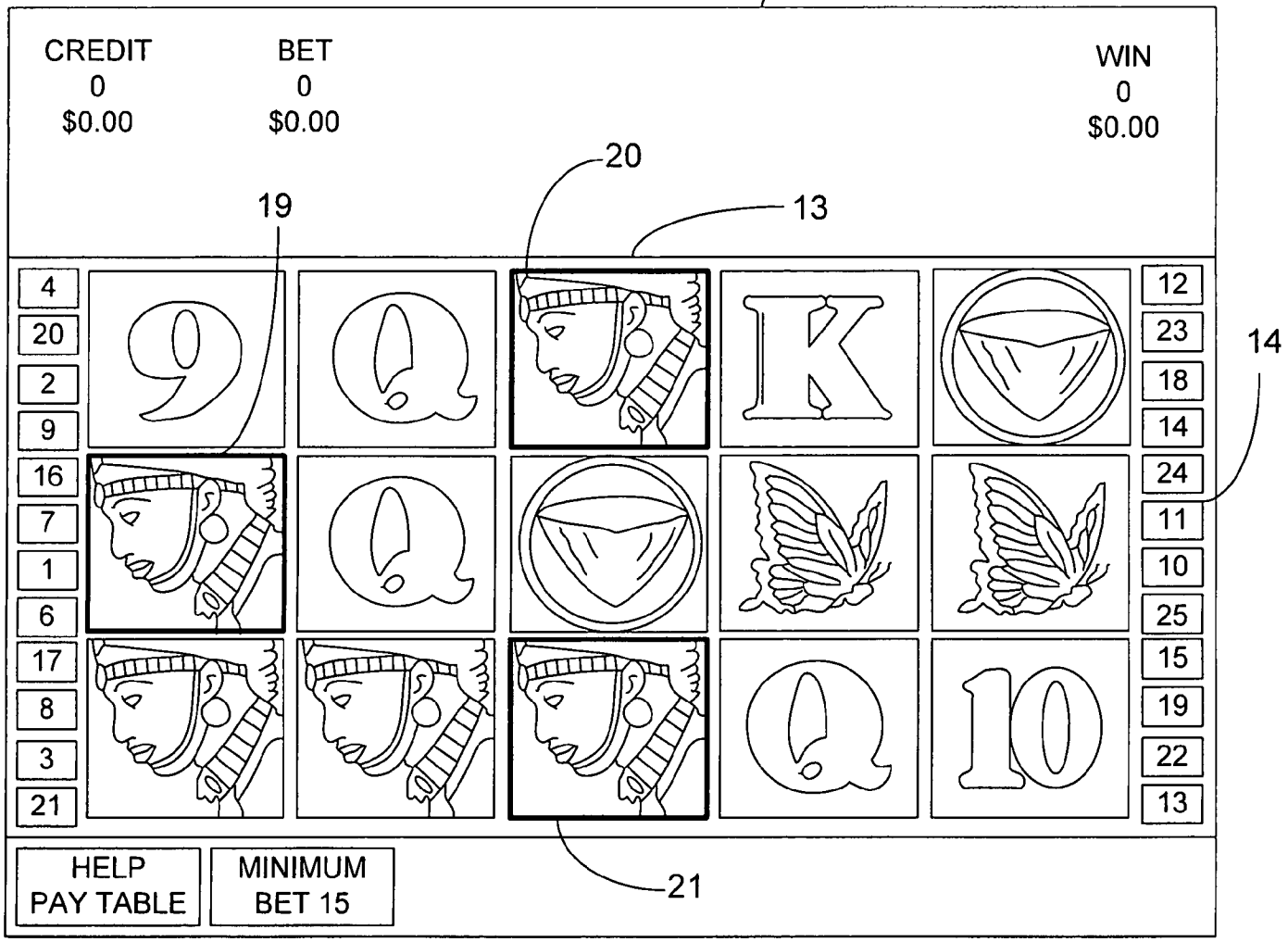
FIG. 7 is a drawing showing the state where the game shown in FIG. 5 has advanced further.

FIG. 7 is a drawing showing the state where a game shown in FIG. 5 has advanced further. The display 2 is shown in FIG. 7. The reel 13 having a plurality of cells and symbols and a plurality of pay lines is displayed on the display 2. FIG. 7 shows the state where a free game has been executed, and the reel has stopped, after the reel has rotated. Selected symbol 22 is displayed in selected cells 19-21. Any kind of symbol may be displayed on cells other than the selected cell. Therefore, symbol 22 or 23, which has been selected, may be displayed on cells other than a selected cell, and a symbol, which was not selected may be displayed.

Figure 8:
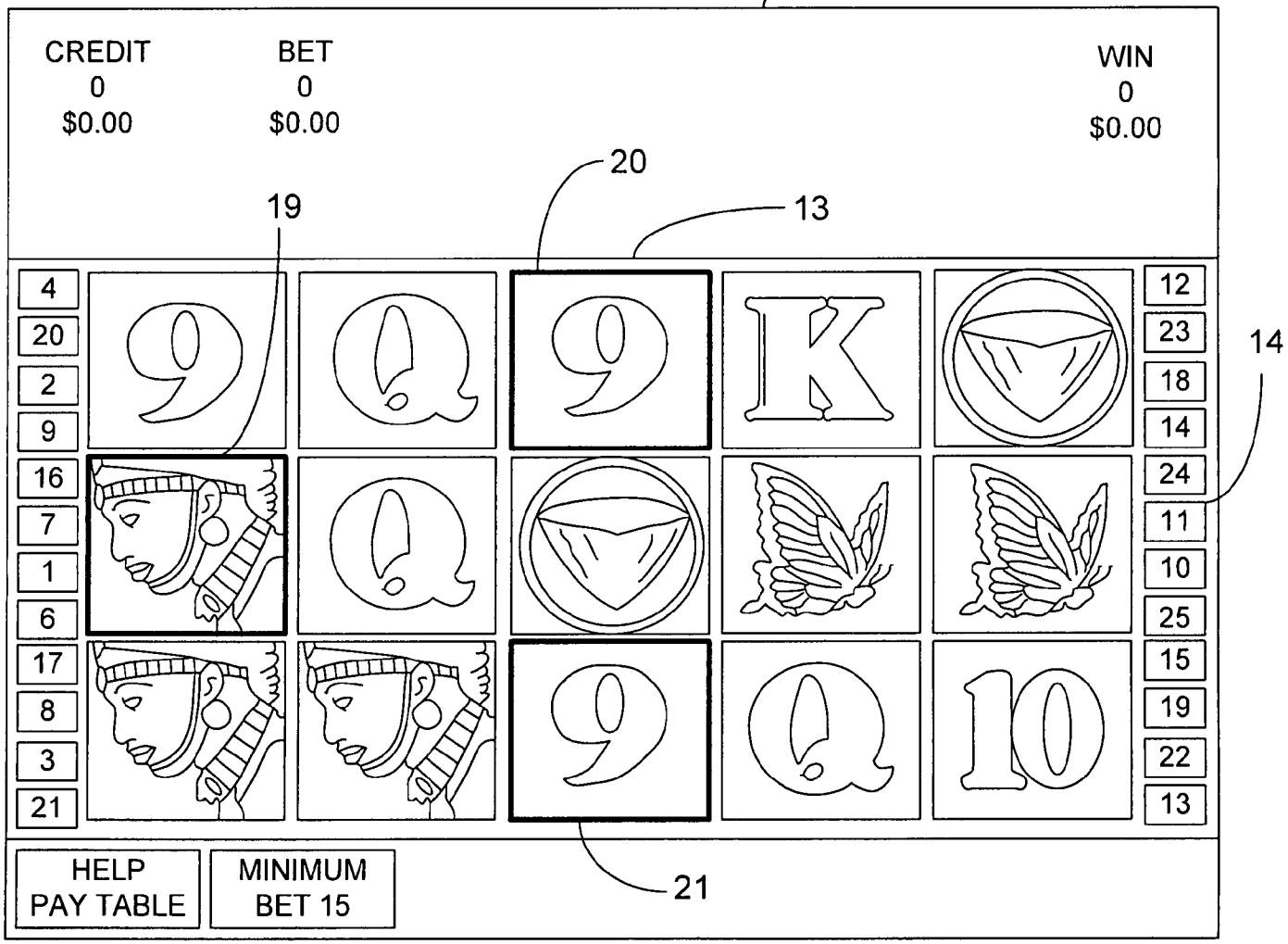
FIG. 8 is a drawing showing the state where the game shown in FIG. 7 has advanced further.

FIG. 8 is a drawing showing the state where the game shown in FIG. 7 has advanced further. The display 2 is shown in FIG. 8. The reel 13 having a plurality of cells and symbols and a plurality of pay lines are displayed on the display 2. FIG. 8 illustrates a state where a reel further performs the spin from a state illustrated in FIG. 7 in the free game, and the reel stopped after that. Selected symbols 22 and 23 are displayed in selected cells 19-21. In cases where there is a plurality of symbols selected in this way, as shown in FIG. 8, in each spin of the free game, all the symbols, which have been selected, may be displayed in the selected cells. As shown in FIG. 7, all selected cells do not need to be displayed in the selected cells.

Figure 9:
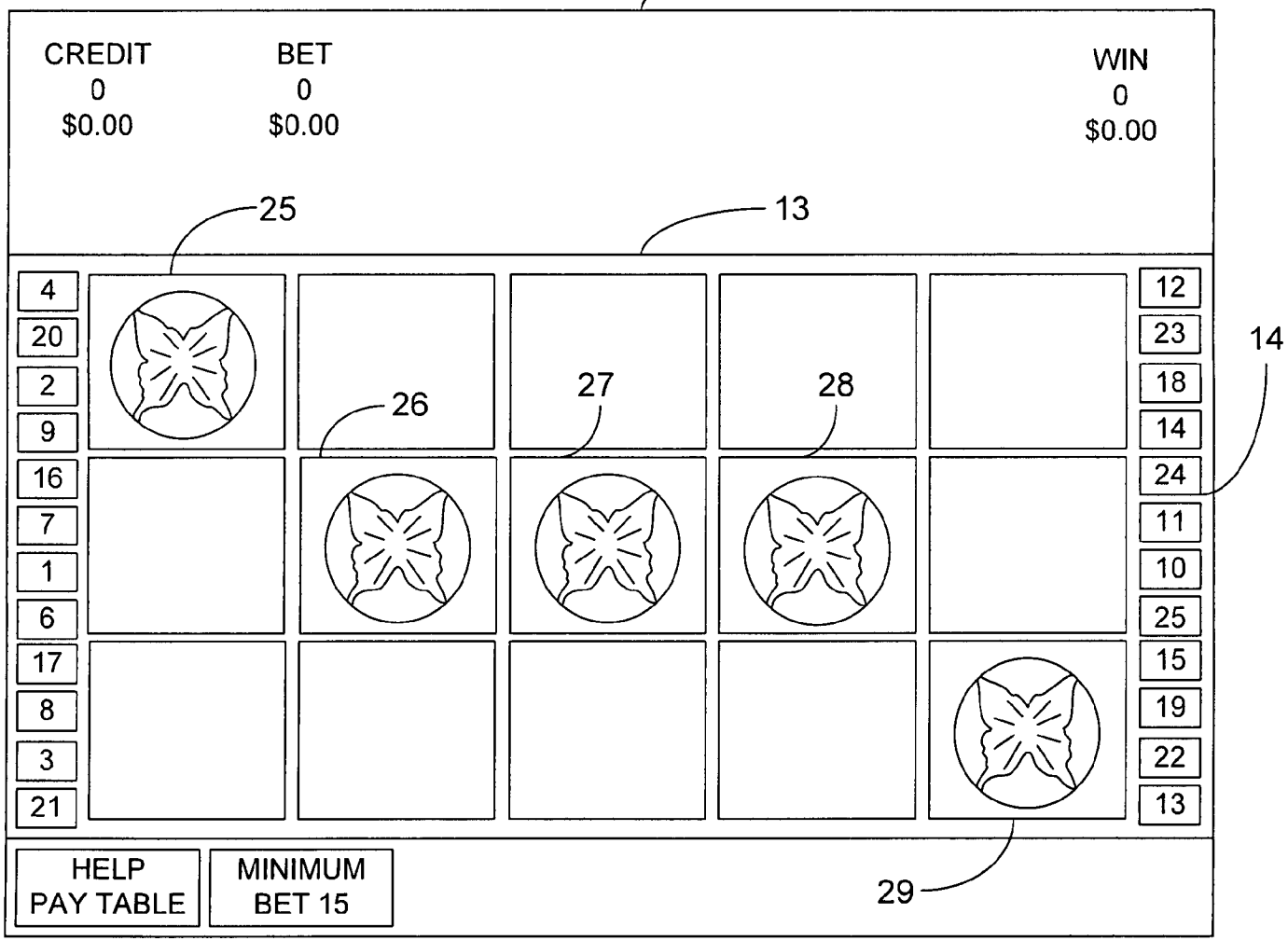
FIG. 9 is a drawing showing an example in the state where a cell on a reel has been selected.

The game, which selects some cells on a reel and performs a free game, has been described above. Any kind of selection method of cells in the game pertaining to the present invention may be acceptable, as following, for example. FIG. 9 is a drawing showing an example in the state where cells on a reel have been selected. In FIG. 9, one cell is selected for every column, and as a whole, cells 25-29 are selected so that it may become a line from the left of a reel to the right. In the free game, a selected symbol will be displayed on the selected cells. A selection method of a symbol may be the same as that of FIG. 6.

Figure 10:
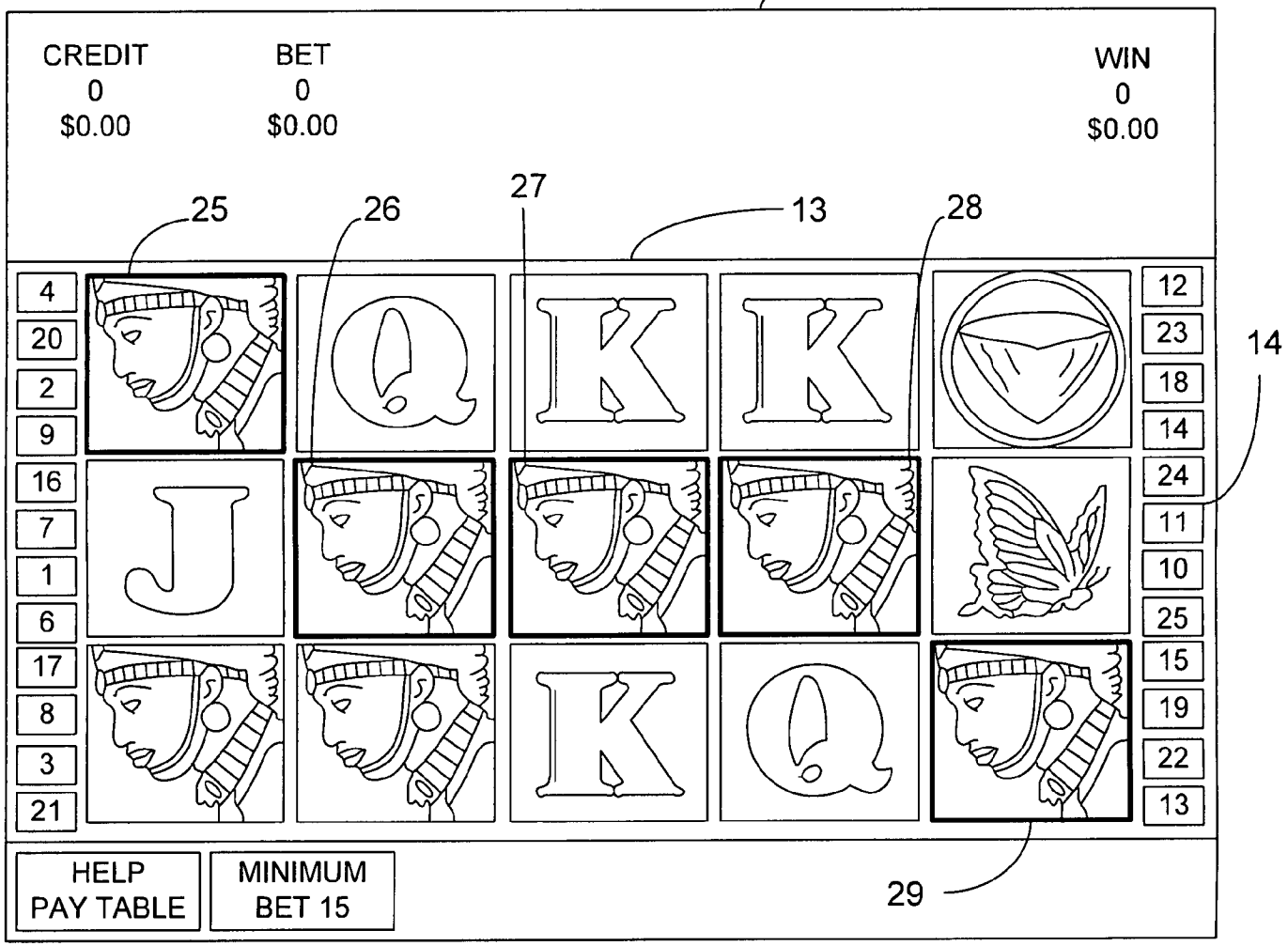
FIG. 10 is a drawing showing the state where the game shown in FIG. 9 has advanced further.

FIG. 10 is a drawing showing the state where the game shown in FIG. 9 has advanced further. The display 2 is shown in FIG. 10. The reel 13 having a plurality of cells and symbols and a plurality of pay lines is displayed on the display 2. FIG. 10 shows the state where a free game has been executed, and a reel stopped, after the reel has rotated. The selected symbol 22 is displayed in selected cells 25-29.

In this case, since selected cells configure a pay line, in cases where the number of selected symbols is one, in all the spins of a plurality of spins performed in a free game, the same symbol will be displayed on this pay line. Therefore, at least, the refund related to the selected pay line will be made in all the spins. Even in cases where a plurality of symbols is selected, a possibility that the same symbols are displayed on the selected pay line is high.

Figure 11:
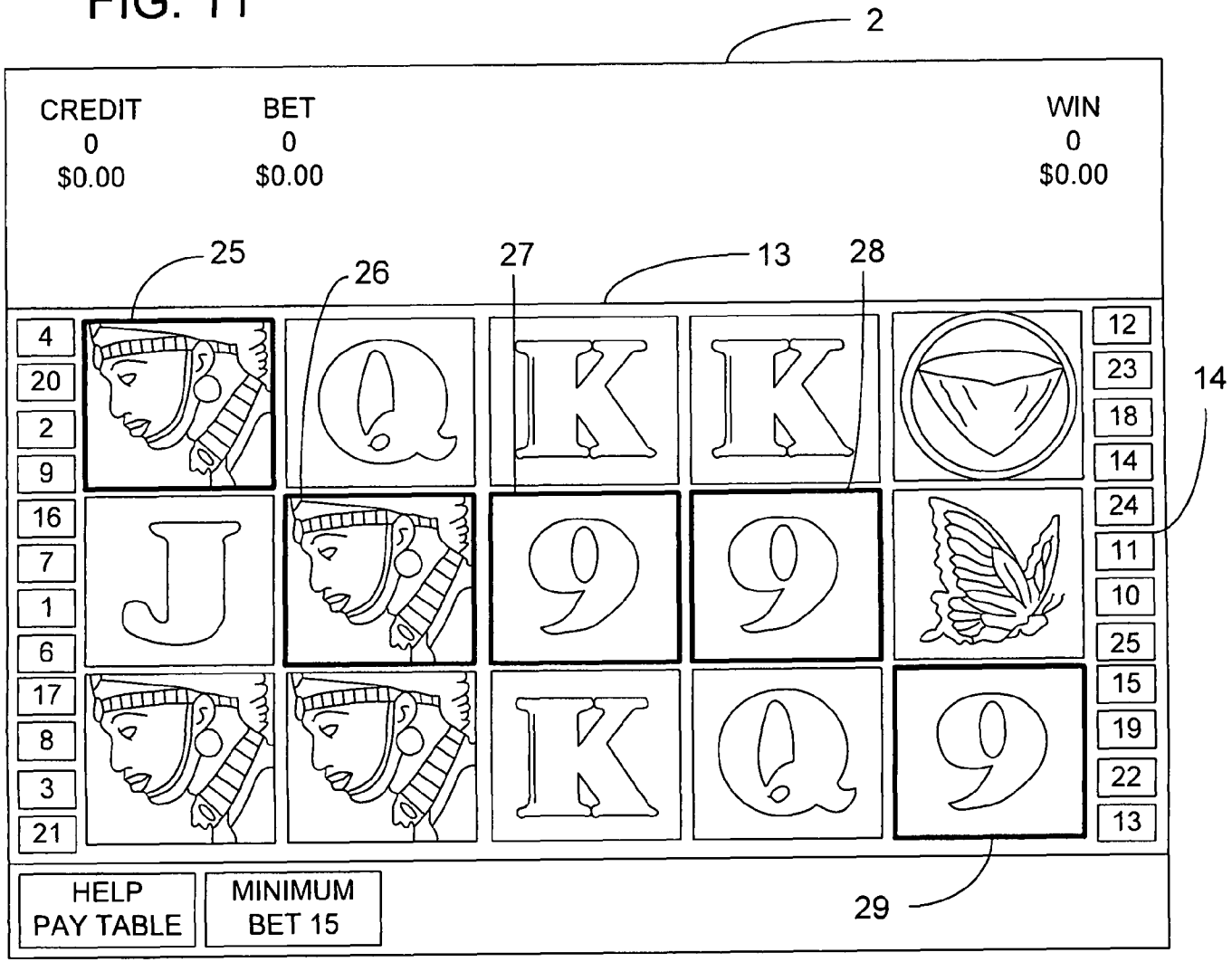
FIG. 11 is a drawing showing the state where the game shown in FIG. 10 has advanced further.

FIG. 11 is a drawing showing the state where the game shown in FIG. 10 has advanced further. The display 2 is shown in FIG. 11. The reel 13 having a plurality of cells and symbols and a plurality of pay lines is displayed on the display 2. FIG. 11 illustrates a state where the reel further performs the spin from the state illustrated in FIG. 10 in the free game, and the reel stopped after that. Selected symbols 22 and 23 are displayed in selected cells 25-29.

As mentioned above, although an example of a game related to the present invention has been described, a game related to the present invention is not limited to these. For example, screens (FIG. 6) for selecting a symbol do not actually need to be displayed on the display 2, and may be automatically selected inside the gaming machine. One kind of symbol or a plurality of kinds of symbols may be acceptable. A selected symbol may be a symbol used in the primary game, and may be a symbol, which is not used in the primary game. As shown in FIG. 6, a selected symbol does not need to be selected from nine symbols and may be selected from a number larger than 9 or a smaller number of symbols.

The cell selection screen does not need to be the display shown in FIGS. 4, 5 and 9. The number of selected cells may be one, or may be plural. Selection of a cell or a symbol may be performed regularly, or it may be carried out at random. Selection of a cell or a symbol may be performed by an apparatus or it may be performed by a player. In one time of a free game, a position of the selected cell, a number, or the kind or the number of symbols that are selected do not always need to be the same. For example, since a spin is made two or more times in the free game, the position of the selected cell for every spin may change, or the kind or the number of symbols, which are selected, may change.

Therefore, for example, the number of selected cells may be increased every time when the number of spins increases in a free game. By doing this way, a set of symbols becomes to be easily arranged every time when the number of spins increases on the reel, and the gamble nature of the game can be increased as the free game approaches to the end. For example, the position of the cell selected in one free game may be changed in every spin. By doing this way, change can be given according to the contents of the free game, and the player can be delighted more.

Although, normally, a free game is configured by a plurality of spins, it is not necessary to display the selected symbol in the selected cells in all spins of them. That is, the selected symbol may be displayed in a selected cell only with a predetermined number of spin in a free game. For example, the selected symbol is displayed in the selected cells three times out of six free spins, and the selected symbol may be displayed without particularly specifying the selected cells and usual reel rotation display may be performed 3 times.

The position of the selected cell may be any kind of positions. As shown in FIG. 2, other cells do not need to rotate a symbol separately and each cell does not need to be displayed. For example, all the cells may rotate symbols at the same timing, and symbol selection may be performed in any kind of forms in the primary game. With regard to the trigger display, it may not be the trigger display illustrated in FIG. 3. Any kind of trigger displays may exist, and the trigger may be performed by a scatter symbol.

Figure 12:
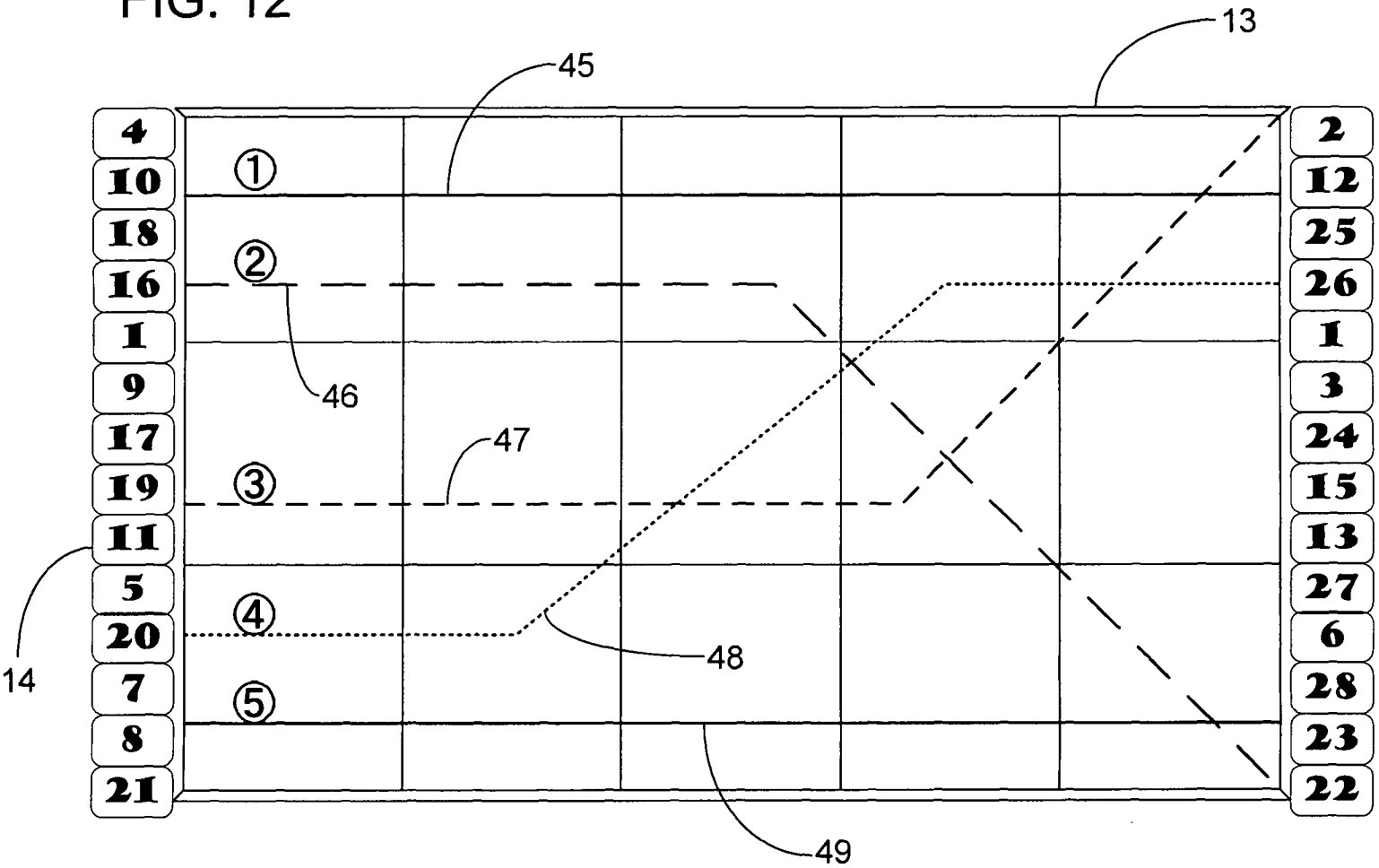
FIG. 12 is a drawing showing an example of the game related to the present invention.

An example of a game related to the present invention will be described. FIG. 12 is a drawing showing an example of a game related to the present invention. The reel 13 provided with a plurality of pay lines 14 is illustrated in FIG. 12. Five lines 45-49 are shown on the reel. A player can start a reel game, after selecting several pay lines from these five lines.

Figure 13:
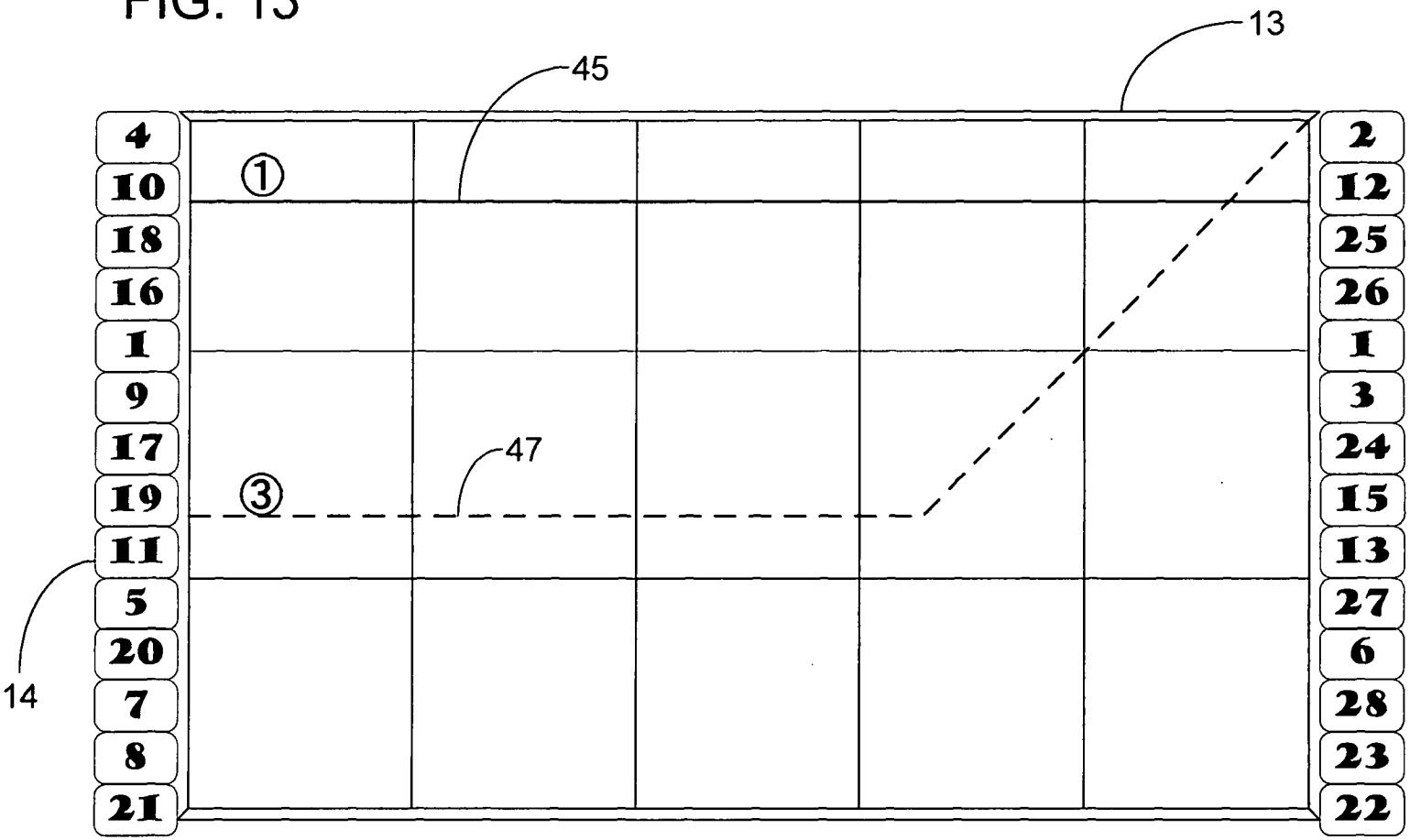
FIG. 13 is a drawing showing the state where the game shown in FIG. 12 has advanced further.

FIG. 13 is a drawing showing the state where the game shown in FIG. 12 has advanced further. FIG. 13 illustrates the reel 13 having a plurality of pay lines 14. Two lines 45 and 47 are shown on a reel. It becomes such a display as a result of the player's selecting lines 45 and 47 among five lines shown in FIG. 12. The player can enjoy a reel game using these two lines. Reward etc. will be made when winning combination is arranged on one of these two lines.

Formerly, a player was not able to select a pay line arbitrarily among two or more lines. The above-mentioned game is to solve this problem. A player can select a line on which winning combination is likely to be arranged most, and the game is arranged to be a game onto which a player's intention can be reflected.

As mentioned above, although a game related to the present invention has been described concretely, a game related to the present invention is not limited to these. For example, the number of lines, on which the chance of selection is given to a player, does not need to be five, and any number of lines will be acceptable. The number of lines which a player selects and can be used for a game does not need to be two, and may be one, or may be three or more. A player is able to make a line from his or her intention. That is, for example, it is also possible, regardless of a line shown in a display screen, for a player to select a plurality of cells and to select a cell so that it may become a form of a pay line as a result.

Figure 14:
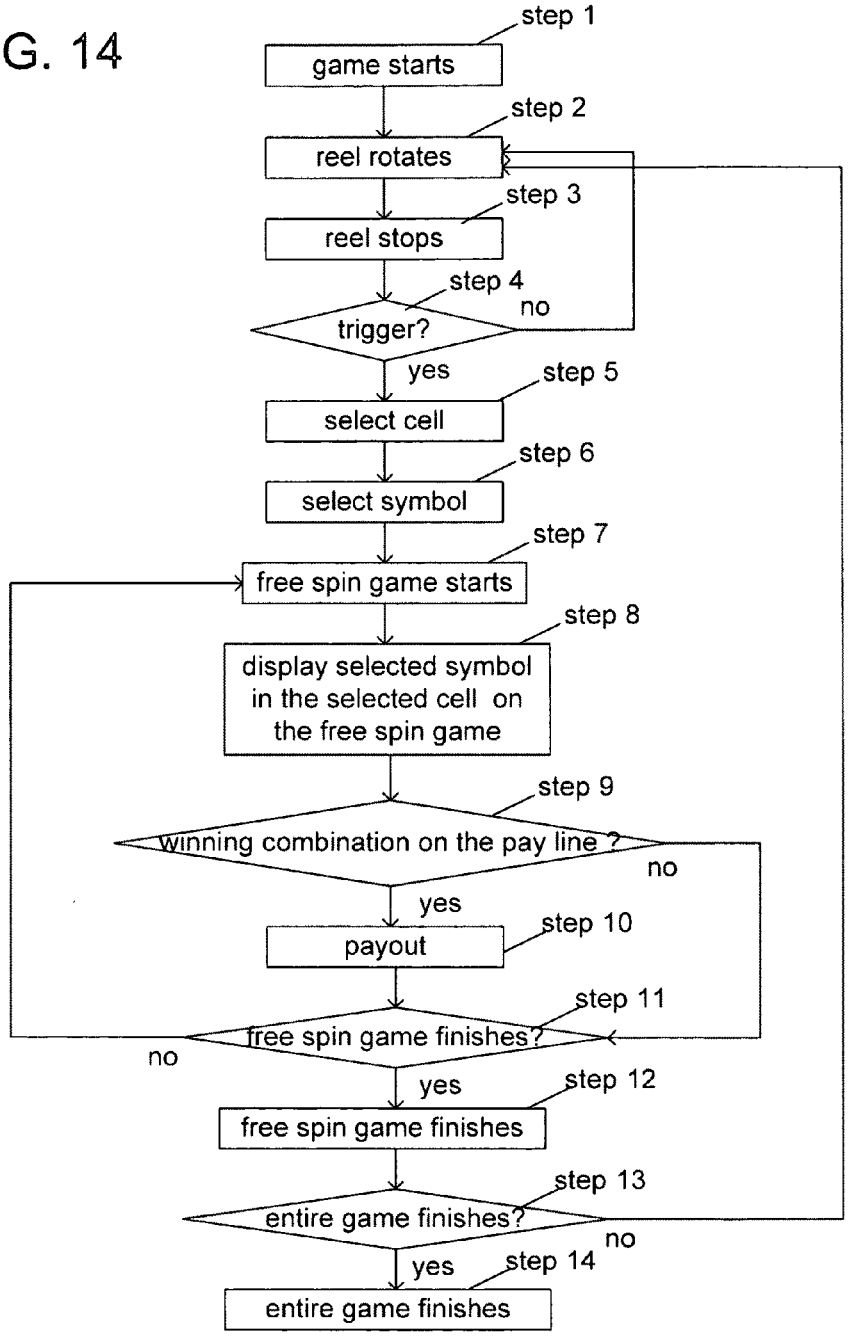
FIG. 14 shows an example of a flow chart with respect to the operation, which is executed by the gaming machine related to the present invention.

Next, operation which is executed by a gaming machine related to the present invention will be described. FIG. 14 shows an example of a flowchart with respect to operation, which is executed by a gaming machine related to the present invention. In FIG. 14, a game starts first (step 1). When game starts, a reel rotates (step 2), and stops (step 3). When the reel stops and a plurality of symbols are displayed on a reel, it will be determined whether the display is a trigger display (step 4). In case when it is not a trigger display, the reel will rotate again and a primary game continues (step 2).

In cases where the reel display is a trigger display, cells used in a free game will be selected (step 5). A symbol to be displayed on the selected cells is selected (step 6). A free game is started after these selections finish (step 7). A free game is configured by a plurality of reel spins and a selected symbol in a selected cells in all the spins are displayed (step 8). And it is determined whether a winning combination is arranged on a pay line on the reel (step 9). Reward etc. are made in cases where a winning combination is arranged on a pay line (step 10). In cases where any winning combination is not arranged and reward, etc are made, it is determined whether a free game is an end (step 11). In cases where it is judged that a free game is not finished, a free game starts again (step 7). A free game is completed in cases where it is judged that a free game is finished (step 12). And it is determined whether the whole game is finished (step 13). In cases where it is judged that the whole game is not finished, the reel rotates again and primary game is started (step 2). The whole game is completed in cases where the whole game is judged to be finished (step 14).

As mentioned above, although the present invention has been described concretely, the present invention is not limited to the above embodiments and various changes and modifications maybe e made without departing from the scope of the invention. For example, operation performed when winning combination is established on a pay line is not limited to refund. When winning combination is established, the issuance of addition of a credit, a gift certificate, a coupon, a free ticket, a meal ticket, etc. may be performed, for example. It may not be limited to a free game that cell selection or pay line selection which is the feature of a present invention is performed, but it may be used for games of any kind of configuration, such as a bonus game, a jack pot game, and a roulette game. Cell selection or pay line selection may be performed not only by secondary game, such as what is called a bonus game but also by a primary game and a subordinate game.

What is claimed is:

1. A gaming machine, comprising:

a display, which displays a plurality of cells for presenting a plurality of symbols in a game and a symbol selection screen consisting of the plurality of cells with symbols to be used in a free spin game;

a bill acceptor which convert a bill into credit for use to play the game;

a processor, which executes the game and the free spin game triggered by a predetermined outcome of the game, wherein after triggering but prior to execution of said free spin game:

the processor chooses at least two cells from the plurality of cells without player's selection and then selects at least one symbol from the symbol selection screen;

the processor selects a predetermined symbol, displays the predetermined symbol in the plurality of cells before choosing at least two cells;

the processor presents the at least one selected symbol in the chosen cells during the execution of the free spin game, and the chosen cells are presented on the display visually distinct from non-chosen cell in the plurality of cells;

a payout device, which awards a reward according to a pay line including the at least one selected symbol on the chosen cells, wherein each of the plurality of cells displays one of the symbols independently from each other, and wherein a quantity of the chosen cells remains the same until at least two spins is executed in the free spin game.

2. The gaming machine of claim 1, wherein the processor randomly chooses the at least two cells.

3. The gaming machine of claim 1, wherein the processor choses the at least two cells on a regular basis.

4. A gaming machine for executing a primary game and a free spin game and paying out credit, comprising:

a display, which displays a plurality of cells in a matrix form having plural columns and rows with symbols, a symbol selection screen consisting of the plurality of cells with symbols to be used in the free spin game, and a plurality of lines on the cells;

a bill acceptor which convert a bill into credit for use to play the game; and a processor, which, prior to execution of said free spin game, is configured to:

select a line from the plurality of lines by selecting a cell in each of the plural columns, select at least one symbol from the symbol selection screen after selecting the line from the plurality of lines, and present the at least one selected symbol in the selected cells related to the selected line without player's selection during the execution of said free spin game, wherein the selected cells are presented on the display visually distinct from non-selected cell in the plurality of cells, wherein the symbols to be used in the free spin game are selected by the processor without the player's selection, and wherein a quantity of the chosen cells remains the same until at least two spins is executed in the free spin game;

a payout device, which pays out the award when the at least one symbol selected from the symbol selection screen is arranged along the pay line form a winning combination; and the processor further selects a predetermined symbol, displays the predetermined symbol in the plurality of cells before selecting the line from the plurality of lines.

5. The gaming machine of claim 4, wherein the line includes a straight line or a zigzag line.

6. The gaming machine of claim 4, wherein the processor randomly selects the line from the plurality of lines.

7. The gaming machine of claim 4, wherein the processor regularly selects the line from the plurality of lines.

8. A method for playing a game on a gaming machine including a display, a processor, a bill acceptor and a payout device, the method comprising the steps of:

receiving a bill via the bill acceptor to convert into credit for use to play the game;

presenting a plurality of symbols in cells in a primary game and a symbol selection screen consisting of a plurality of cells with symbols to be used in a free spin game on the display;

indicating trigger information in the primary game presented on the display;

initiating a free spin game, based at least in part on the trigger information, with the cells presenting the symbols on the display;

selecting, prior to execution of said free spin game, at least two cells in the plurality of cells and then selecting at least one symbol from the symbol selection screen to be used in the free spin game by the processor without player's selection;

selecting a predetermined symbol and displaying the predetermined symbol in the plurality of cells before selecting at least two cells;

displaying the selected symbol in the selected cells on the display during the execution of said free spin game, wherein the selected cells are presented on the display visually distinct from non-selected cell in the plurality of cells; and awarding credit when the symbols displayed in the plurality of cells form a winning combination including the at least one selected symbol through the payout device, wherein a quantity of the selected cells remains the same until at least two spins is executed in the free spin game.

9. The method of claim 8, wherein the presenting step includes the step of presenting the plurality of symbols in the cells, each cell independently displaying a symbol from each other.

10. A gaming machine for paying out award according to a bet in a game, comprising:

a display, which displays a plurality of cells with symbols, a symbol selection screen for displaying symbols to be used in a free spin game, and a plurality of lines on the cells, wherein the symbol selection screen consisting of a second plurality of cells, which displays the symbols to be used in the free spin game;

a bill acceptor which convert a bill into credit for use to play the game;

a processor, which assigns a set of cells as a pay line, and then presents at least one symbol selected from the symbol selection screen on the set of cells during the execution of said free spin game, the processor being arranged to select symbols and to assign the pay line prior to execution of said free spin game so as to be used in the free spin game without player's selection, wherein the processor further selects a predetermined symbol, displays the predetermined symbol in the plurality of cells before assigning the set of cells, wherein the assigned cells are presented on the display visually distinct from non-assigned cell in the plurality of cells; and a payout device, which pays out the award when the at least one symbol selected from the symbol selection screen is arranged along the pay line form a winning combination, wherein the quantity of the cells along the pay line remains the same until at least two spins is executed in the free spin game.

* * * * *